United States Patent [19]

Lu et al.

[11] 4,442,189

[45] Apr. 10, 1984

[54] TONER COMPOSITIONS CONTAINING POLYANHYDRIDE RESINS

[75] Inventors: Chin H. Lu; Christopher J. AuClair, both of Webster, N.Y.

[73] Assignee: Xerox Corporation, Stamford, Conn.

[21] Appl. No.: 461,088

[22] Filed: Jan. 26, 1983

[51] Int. Cl.[3] ..... G03G 9/08; G03G 9/10

[52] U.S. Cl. ..... 430/45; 430/106; 430/109; 430/110

[58] Field of Search ..... 430/109, 110, 114, 115, 430/45, 106

[56] References Cited

U.S. PATENT DOCUMENTS

| | | | |
|---|---|---|---|
| 3,609,082 | 9/1971 | Moriconi et al. . | |
| 3,776,849 | 12/1973 | Tellier | 430/115 |
| 3,869,397 | 3/1975 | Tellier | 430/115 X |
| 3,884,825 | 5/1975 | Lindblad et al. . | |
| 4,073,739 | 2/1978 | Peters . | |
| 4,264,699 | 4/1981 | Tsubuko et al. | 430/114 X |
| 4,298,672 | 11/1981 | Lu | 430/108 |
| 4,338,390 | 7/1982 | Lu | 430/106 |
| 4,403,027 | 9/1983 | Ishikawa et al. | 430/110 |

FOREIGN PATENT DOCUMENTS

| | | | |
|---|---|---|---|
| 2907633 | 9/1979 | Fed. Rep. of Germany | 430/109 |
| 53-104238 | 9/1978 | Japan | 430/109 |
| 54-130029 | 10/1979 | Japan | 430/109 |

*Primary Examiner*—Roland E. Martin, Jr.
*Attorney, Agent, or Firm*—E. O. Palazzo

[57] ABSTRACT

This invention is generally directed to dry negatively charged toner compositions comprised of resin particles, pigment particles and a polyanhydride charge enhancing composition of the formula:

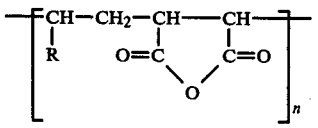

wherein R is an alkyl group containing from about 6 carbon atoms to about 22 carbon atoms, and n is a number ranging from about 5 to about 2,000.

23 Claims, No Drawings

TONER COMPOSITIONS CONTAINING POLYANHYDRIDE RESINS

BACKGROUND OF THE INVENTION

This invention is generally directed to developer conditions and toner compositions, and more specifically, the present invention is directed to developer compositions, and toner compositions containing certain charge enhancing additives. In one embodiment, the present invention is directed to developer compositions containing toner particles, and polyanhydride resins as charge enhancing additives, which additives impart a negative charge to the toner resin particles. The polyanhydride materials can also be selected as resin binders for electrostatic toner compositions. Developer compositions containing the charge enhancing additives of the present invention are useful for causing the development of electrostatic latent images, including color images. Furthermore, the toner compositions of the present invention can be selected for use with common carrier particles of the same composition, especially with regard to the development of colored electrostatic images.

Developer compositions containing charge enhancing additives are known in the prior art, particularly, those compositions containing charge enhancing additives which impart a positive charge to the toner resin. However, very few developer compositions are known wherein the charge enhancing additives are selected for the purpose of imparting a negative charge to the toner resin particles. Examples of positively charged systems include those described in U.S. Pat. No. 4,298,672, wherein there is disclosed toner compositions containing alkyl pyridinium halides as charge enhancing additives. More specifically, this patent discloses developer compositions containing from about 0.1 percent by weight to about 10 percent by weight of cetyl pyridinium chloride as a positive charge enhancing additive. Further, there is disclosed in U.S. Pat. No. 3,893,935 the use of certain quaternary ammonium compounds as charge control agents for electrostatic toner compositions. A similar teaching is described in U.S. Pat. No. 4,079,014 with the exception that the charge control agent disclosed a diazo compound.

Moreover, there is disclosed in a co-pending application developer compositions containing as negative charge enhancing additives orthohalophenyl carboxylic acids, including for example, 2-fluorobenzoic acid, 2,6-difluorobenzoic acid, 2-fluoro-6-chlorobenzoic acid, and the like.

While the referenced charge enhancing additives are suitable for their intended purposes, there continues to be a need for new charge enhancing additives, particularly those charge enhancing additives which impart a negative charge to the toner resin particles. Additionally, there continues to be a need for charge enhancing additives which can be easily uniformly dispersed in the toner resin particles, and wherein the resulting developer toner composition has a narrow charge distribution, thereby allowing improved image quality. Furthermore, there continues to be a need for a charge enhancing additive which is relatively free from toxicity problems. Additionally, there continues to be a need for charge enhancing additives that are insoluble in water, and insensitive to various humidity conditions, which additives can also be selected for use as the toner resin particles.

SUMMARY OF THE INVENTION

It is an object of the present invention to provide toner compositions and developer compositions containing negative charge enhancing additives.

In another object of the present invention there is provided negatively charged toner compositions which are useful for causing the development of electrostatic latent images, including color images.

In yet another object of the present invention there is provided negatively charged toner compositions containing as charge enhancing additives certain polyanhydride resins.

In another object of the present invention there is provided negatively charged toner particles which contain certain polyanhydride compositions as the resinous binder.

In a further object of the present invention there are provided color developer compositions comprised of toner particles, common carrier particles and certain polyanhydride resin materials as charge enhancing additives, which additives impart a negative charge to the toner resin particles.

In yet another object of the present invention there are provided polyanhydride charge enhancing additives which are compatible with the toner resin particles, and therefore can be easily uniformly dispersed therein.

An additional object of the present invention resides in the provision of negatively charged toner compositions possessing narrow charge distribution curves, thus enabling improved image quality subsequent to development, these compositions containing certain polyanhydride resins.

In yet another object of the present invention there are provided certain polyanhydride resin materials which are substantially free from toxicity.

In a further object of the present invention there are provided polyanhydride charge enhancing additives which are insoluble in water, and relatively insensitive to humidity conditions.

These and other objects of the present invention are accomplished by the provision of electrostatic toner compositions, and developer compositions thereof, wherein the toner compositions are comprised of resin particles, colorant and/or pigment particles, and a polyanhydride resin charge enhancing additive of the formula:

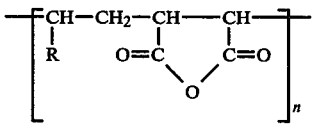

wherein R is an alkyl group containing from about 6 carbon atoms to about 22 carbon atoms, and preferably from about 12 carbon atoms to about 18 carbon atoms, and n is a number ranging from about 5 to about 2,000, and preferably from about 50 to about 200.

Illustrative examples of alkyl groups include hexyl, heptyl, octyl, nonyl, decyl, myristyl, cetyl, stearyl and the like. Preferred alkyl groups are myristyl, cetyl, and stearyl.

Illustrative examples of polyanhydride resin compositions embraced within the scope of the present invention include those materials that are copolymers of an olefin and maleic anhydride. Specifically, polyanhydride resins useful include those comprised of copolymers of octadecene-1, and maleic anhydride, copolymers of hexadecene-1, and maleic anhydride, copolymers of tetradecene-1, and maleic anhydride, and copolymers of dodecene-1, and maleic anhydride. Generally the molar ratio of olefin to maleic anhydride is from about 1.0:0.1, to about 0.1:1.0, and preferably from about 1.0:0.5 to about 0.5:1.0. These polyanhydride compositions are commercially available, thus for example, the 1:1 molar ratio of olefin polyanhydride material is commercially available from Gulf Oil Chemicals Company as Gulf PA-18 polyanhydride resin. Oral toxicity tests for this Gulf resin indicate that it is relatively non-toxic. Further skin irritation tests indicate that the Gulf polyanhydride resin is not a primary skin irritant.

The polyanhydride resin materials of the present invention can be used in toner compositions and developer compositions in various amounts provided they do not adversely affect these materials and result in a toner that is negatively charged in comparison to the carrier particles selected. Generally, the amount of polyanhydride resin selected ranges from about 0.1 percent to about 98 percent by weight, based on the weight of the toner particles, and preferably from about 0.1 percent to about 10 percent by weight. The polyanhydride resin of the present invention can also be present as a substitute for the toner resin particles.

The polyanhydride resin particles of the present invention can either be blended into the toner composition, or coated on the colorant or pigment, such as carbon black, cyan material, magenta material, or yellow material, which is selected as a colorant or pigment for the developer composition. When selected as a coating, the charge enhancing additive of the present invention is present in an amount of from about 2 weight percent to about 20 weight percent, and preferably from about 5 weight percent to about 10 weight percent, based on the weight of the colorant or pigment.

Various known methods can be utilized in preparing the toner and developer compositions of the present invention, one method involving melt blending the resin particles and pigment particles coated with the polyanhydride resin particles of the present invention, followed by mechanical attrition. Other methods include those well known in the art such as spray drying, melt dispersion, dispersion polymerization, and suspension polymerization. In spray drying a solvent dispersant of resin particles, pigment particles and the polyanhydride resin particles of the present invention are spray dried under controlled conditions resulting in the desired product. A toner prepared in this manner results in negatively charged toner particles in relationship to the carrier materials present in the developer composition; and these compositions exhibit the improved properties disclosed herein.

Various suitable resins can be utilized with the charge enhancing additives of the present invention. Typical resins include, for example, thermoplastic materials, such as polyamides, epoxies, polyurethanes, vinyl resins, and polyesters, especially those prepared from dicarboxylic acids and diols comprising diphenols. Any suitable vinyl resin may be selected for the toner composition of the present invention, including homopolymers or copolymers of two or more vinyl monomers. Typical of such vinyl monomeric units include: styrene, p-chlorostyrene, vinyl naphthalene, ethylenically unsaturated monoolefins such as ethylene, propylene, butylene, isobutylene and the like; vinyl halides such as vinyl chloride, vinyl bromide, vinyl fluoride, vinyl esters such as vinyl acetate, vinyl propionate, vinyl benzoate, vinyl butyrate and the like; esters of aliphamethylene aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl indole, N-vinyl pyrrolidene and the like; and mixtures thereof. Also useful as the toner resin particles are copolymers of styrene and butadiene.

Generally, toner resins containing relatively high percentages of styrene are preferred. The styrene resin used may be a homopolymer of styrene, or of styrene homologs of copolymers of styrene with other monomeric groups. Any of the above typical monomeric units may be copolymerized with styrene by addition polymerization. Styrene resins may also be formed by the polymerization of mixtures of two or more unsaturated monomeric materials with a styrene monomer. The addition polymerization technique employed embraces known polymerization techniques such as free radical, anionic, and cationic polymerization processes. Any of these vinyl resins may be blended with one or more resins if desired, preferably other vinyl resins, which ensure good triboelectric properties and uniform resistance against physical degradation. However, non-vinyl type thermoplastic resins may also be selected including resin modified phenolformaldehyde resins, oil modified epoxy resins, polyurethane resins, cellulosic resins, polyether resins, and mixtures thereof.

Also esterification products of a dicarboxylic acid, and a diol comprising a diphenol may be used as a preferred resin material for the toner composition of the present invention. These materials are illustrated in U.S. Pat. No. 3,655,374, the disclosure of which is totally incorporated herein by reference, the diphenol reactant being of the formula as shown in Column 4, beginning at line 5, of this patent and the dicarboxylic acid component being of the formula as shown in Column 6.

The resin particles are present in an amount that provides a total of about 100 percent for all toner ingredients, thus when 5 percent by weight of the charge enhancing composition of the present invention is present, and 10 percent by weight of pigment or colorant particles such as carbon black are present, about 85 percent by weight of resin material is incorporated into the toner composition.

With regard to developer composition utilized for the development of electrostatic latent images wherein there results a black image, various suitable pigments or dyes can be utilized as the colorant for the toner particles, such materials being well known, and including for example, carbon black, magnetite, iron oxides, nigrosine dye, chorme yellow, ultramarine blue, duPont oil red, methylene blue chloride, phthalocyanine blue and mixtures thereof. The pigment or dye should be present in the toner in sufficient quantity to render it highly colored, thus allowing the toner composition to create a clearly visible image on the recording member. Thus, for example, when conventional xerographic copies of documents are desired, the toner may comprise a black pigment, such as carbon black, or a black dye such as Amaplast black dye available from the National Aniline Products, Inc. Preferably, the pigment is employed in amounts of from about 3 percent by weight to about 50 percent by weight based on the total weight of the toner particles, however, if the pigment selected is a dye, substantially smaller quantities, for example, less than 10 percent by weight, may be used.

With regard to developer composition utilized for obtaining color images, there is selected as the colorant or pigment particles, cyan pigments, magenta pigments, yellow pigments, and mixtures thereof. Illustrative examples of cyan pigments include copper tetra-4-(octadecylsulfonamido) phthalocyanine, the X-copper phthalocyanine pigment listed in the color index as Cl 74160, Cl Pigment Blue 15, an Anthradanthrene blue identified in the color index as Cl 61890, Special Blue X-2137 and the like; while illustrative examples of yellow pigments that may be selected include diarylide yellow 3,3-dichloro benzidene acetoacetanilide a monoazo pigment identified in the color index as Cl 12700; Cl Solvent Yellow 16, a nitrophenyl amine sulfonamide identified in the color index as Foron Yellow SE/GLF; Cl Dispersed Yellow 33, 2,5-dimethoxy-4-sulfonoanilide phenylazo-4-chloro-2,5-dimethoxy acetoacetanilide, permanent yellow FGL, and the like. Illustrative examples of magenta materials that may be selected as pigments, include for example, 2,9-dimethyl substituted quinacridone and anthraquinone dye identified in the color index as Cl 60710, Cl Dispersed Red 15, a diazo dye identified in the color index as Cl 26050, Cl Solvent Red 19; Lithol Scarlet, and the like.

The cyan, magenta and yellow pigments, when utilized with the charge enhancing additives of the present invention are generally incorporated into the toner composition in an amount of from about 2 weight percent to about 30 weight percent, and preferably from about 5 weight percent to about 15 weight percent, based on the weight of the toner particles.

Various suitable carrier particles can be incorporated into the developer composition of the present invention, providing that the toner particles are charged negatively in comparison to the carrier particles. Thus, the carrier particles are selected so as to acquire a charge of a positive polarity, and include materials such as steel, nickel, iron ferrites, silicon dioxide, and the like. The carrier particles may contain a coating such as polymers of styrene, methyl methacrylate, and silanes, ethyl cellulose, and the like. Many of the typical carriers that can be used are described in U.S. Pat. No. 3,638,522. Also nickel berry carriers as described in U.S. Pat. Nos. 3,847,604 and 3,767,598 can be employed, these carriers being nodular carrier beads of nickel characterized by surfaces of reoccurring recesses and protrusions, thus providing particles with a relatively large external area. The diameter of the coated carrier particle is from about 50 to about 1,000 microns, thus allowing the carrier to possess sufficient density and inertia to avoid adherence to the electrostatic images during the development process.

The carrier particles may be mixed with the toner composition in various suitable combinations, however, best results are obtained when about 1 part of toner particles to about 10 to about 200 parts by weight of carrier particles are utilized.

The toner and developer compositions of the present invention may be used to develop electrostatic latent images, including color images, on various suitable imaging surfaces, capable of retaining charge including, for example, conventional photoreceptor surfaces known in the art, such as inorganic photoconductors, like selenium, and layered photoresponsive devices, wherein positive charges reside on the photoresponsive surfaces, which method comprises contacting the electrostatic latent image with the developer composition of the present invention, followed by transferring the resulting image to a suitable substrate, and optionally permanently affixing the image thereto by, for example, heat. In addition to selenium, illustrative examples of useful inorganic photoreceptors include halogen doped amorphous selenium, alloys of amorphous selenium, such as arsenic selenium, selenium tellurium, and the like, halogen doped selenium alloys, cadmium sulfide, zinc oxide, and the like. Amorphous selenium and a selenium arsenic alloy containing about 99.95 percent selenium and 0.5 percent arsenic are preferred. Color images can be obtained using, for example, a single pass process as described in U.S. Pat. No. 4,312,932 the disclosure of which is totally incorporated herein by reference.

The following examples are being supplied to further define certain embodiments of the present invention, it being noted that these examples are intended to be illustrative only and are not intended to limit the scope of the present invention. Parts and percentages are by weight unless otherwise indicated.

EXAMPLE I

The following four (4) brown toner compositions were prepared by melt blending in a Banbury mill, followed by mechanical attrition. Control toner composition A contained 90 percent by weight of a styrene/n-butylmethacrylate copolymer resin, (58 percent by weight of styrene and 42 percent by weight of n-butylmethacrylate), and 10 percent by weight of a blend of yellow, magenta and cyan pigment, in a ratio of 9:3:1, the yellow pigment being 2,5-dimethoxy-4-sulfonanilide phenylazo-4'-chloro-2,5-dimethoxy acetoacetanilide, permanent yellow FGL, the magenta pigment being 2,9-dimethyl substituted quinacridone, and the cyan pigment being comprised of copper tetra-4-(octadecylsulfonamido) phthalocyanine. No charge enhancing additive was included in control toner composition A.

Toner compositions B, C and D were prepared by repeating the procedure for the preparation of toner composition A, with the exception that these toner compositions contained 88 percent by weight of a styrene n-butylmethacrylate copolymer resin, and 2 percent by weight of a polyanhydride charge enhancing additive PA-18, 85 percent by weight of a styrene n-butylmethacrylate copolymer resin, and 5 percent by weight of the polyanhydride resin, PA-18, and 80 percent by weight of a styrene n-butylmethacrylate copolymer resin, and 10 percent by weight of the polyanhydride resin, PA-18. The polyanhydride resin charge enhancing additive is commercially available from Gulf Oil Chemicals Company as PA-18, which resin is believed to be a copolymer 1:1 molar ratio, of octadecene-1, and maleic anhydride, having a molecular weight of about 50,000, and being of the following formula:

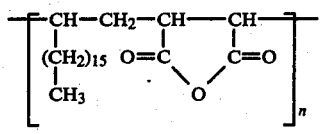

The toner compositions prepared where then classified to remove particles below 5 microns, and triboelectric charge measurements with a Faraday cage, were then affected for each toner composition against ferrite carrier particles consisting of a ferrite core coated with 0.5 weight percent of a methylmethacrylate/styrene/triethoxysilane terpolymer, reference U.S. Pat. No. 3,526,533, at 2 percent by weight toner concentration with the following results:

| Toner | Percent by weight of PA-18 | Toner Triboelectric Values in Microcoulombs per gram (uc/g) 10 min | 60 min | 180 min | 300 min |
|---|---|---|---|---|---|
| A (Control) | 0 | −9 | −12 | −14 | −13 |
| B | 2 | −15 | −23 | −25 | −25 |
| C | 5 | −24 | −34 | −37 | −34 |
| D | 10 | −26 | −43 | −52 | −54 |

Toner compositions B, C and D containing the polyanhydride charge enhancing additive PA-18 exhibited higher negative toner triboelectric values than control toner A which contained no charge control additive.

EXAMPLE II

There was prepared red toner compositions by repeating the procedure of Example I with the exception that in place of the yellow, magenta and cyan pigments, there was substituted Lithol Scarlet pigment, a red pigment available from BSAF Corporation, while varying the amount of styrene n-butylmethacrylate copolymer resin selected for toner compositions F and G. There was thus prepared by melt blending followed mechanical attrition toner compositions containing the following components in the amounts indicated:

| Toner | Percent by weight Lithol Scarlet | Percent by weight Gulf PA-18 | Styrene/n-butyl methacrylate (58/42) copolymer resin-wt. percent |
|---|---|---|---|
| E (Control) | 10 | 0 | 90 |
| F | 10 | 2 | 88 |
| G | 10 | 5 | 85 |

The toner compositions were then classified to remove particles smaller than 5 microns. Triboelectric measurements with Faraday case, against the ferritecarrier described in Example I resulted in the following:

| Toner | Percent by weight of PA-18 | Toner Triboelectric Values in Microcoulombs per gram (uc/g) 10 min | 60 min | 180 min | 300 min |
|---|---|---|---|---|---|
| E (Control) | 0 | −9 | −14 | −14 | −15 |
| F | 2 | −15 | −20 | −21 | −21 |
| G | 5 | −18 | −19 | −20 | −20 |

Toners F and G which contained a polyanhydride resin as a charge enhancing additive showed significantly higher triboelectric values than control, Toner E.

EXAMPLE III P The toner compositions E and G, prepared in accordance with Example II were also measured for triboelectric values, with a Faraday cage, against ferrite carrier particles consisting of a ferrite core coated with 0.43 weight percent of ethyl cellulose, with the following results:

| Toner | Percent by weight of PA-18 | Toner Triboelectric Values in Microcoulombs per gram (uc/g) 10 min | 60 min | 180 min | 300 min |
|---|---|---|---|---|---|
| E (Control) | 0 | −32 | −25 | −19 | −17 |
| G | 5 | −79 | −68 | −55 | −48 |

Toner G containing 5 weight percent of the polyanhydride resin PA-18 showed substantially higher triboelectric values than the control, Toner E which contained no PA-18 charge enhancing additive.

EXAMPLE IV

Developer compositions were prepared by mixing together two parts by weight of the toner compositions of Examples I, II, and IV, containing the polyanhydride charge enhancing additives indicated, with 100 parts by weight of carrier particles consisting of a ferrite core coated with 0.5 percent of a methylmethacrylate/styrene/triethoxysilane terpolymer, reference U.S. Pat. No. 3,526,533.

The resulting developer compositions when utilized to develop latent electrostatic images formed on an amorphous selenium photoreceptor device charged positively, resulted in colored copies of excellent quality with a single pass xerographic color imaging process, subsequent to transfer to paper and fixing by heat. Substantially similar results were obtained with developer compositions prepared by mixing together 2 parts by weight of the toner composition of Example III, containing the polyanhydride charge enhancing additive indicated, with 100 parts by weight of carrier particles consisting of a ferrite core coated with 0.43 percent by weight of ethyl cellulose when this developer composition was selected for developing electrostatic latent images formed on an amorphous selenium receptor device charged positively.

Other modifications of the present invention will occur to those skilled in the art based upon a reading of the present disclosure and these modifications are intended to be included within the scope of the present invention.

We claim:

1. A dry negatively charged toner composition comprised of resin particles, pigment particles and a polyanhydride charge enhancing composition of the formula:

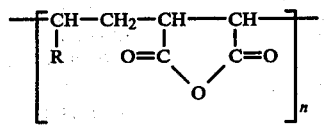

wherein R is an alkyl group containing from about 6 carbon atoms to about 22 carbon atoms, and n is a number ranging from about 5 to about 2,000.

2. A toner composition in accordance with claim 1 wherein R is an alkyl group containing from about 12 carbon atoms to about 18 carbon atoms, and n is a number ranging from 5 to 200.

3. A toner composition in accordance with claim 1 wherein the polyanhydride composition is present in an amount of from about 0.1 weight percent to about 98 weight percent.

4. A toner composition in accordance with claim 1 wherein the polyanhydride composition is present in an amount of from about 0.1 weight percent to about 10 weight percent.

5. A toner composition in accordance with claim 1 wherein the polyanhydride composition is a copolymer of octadecene-1 and maleic anhydride.

6. A toner composition in accordance with claim 1 wherein the polyanhydride composition is a copolymer of hexadecene-1 and maleic anhydride.

7. A toner composition in accordance with claim 1 wherein the polyanhydride composition is a copolymer of tetradecene-1 and maleic anhydride.

8. A toner composition in accordance with claim 1 wherein the polyanhydride composition is a copolymer of dodecene-1 and maleic anhydride.

9. A toner composition in accordance with claim 1 wherein the resin particles are comprised of styrene/n-butylmethacrylate copolymer.

10. A toner composition in accordance with claim 1 wherein the pigment particles are carbon black, cyan, magenta, yellow, scarlet, or mixtures thereof.

11. A developer composition comprised of negatively charged toner particles, comprised of resin particles, pigment particles, and a polyanhydride charge enhancing composition of the formula:

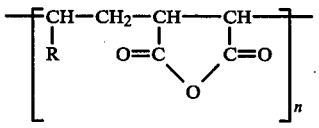

wherein R is an alkyl group containing from about 6 carbon atoms to about 22 carbon atoms, and n is a number ranging from about 5 to about 2,000, and carrier particles.

12. A developer composition in accordance with claim 11 wherein the polyanhydride composition is present in an amount of from about 0.1 weight percent to 98 weight percent.

13. A developer composition in accordance with claim 11 wherein the polyanhydride composition is a copolymer of octadecene-1 and maleic anhydride, hexadecene-1 and maleic anhydride, tetradecene-1 and maleic anhydride, and dodecene-1 and maleic anhydride.

14. A developer composition in accordance with claim 11 wherein the toner resin particles are comprised of a styrene/n-butylmethacrylate copolymer.

15. A developer composition in accordance with claim 11 wherein the carrier particles consist of a ferrite core coated with a terpolymer of styrene, methylmethacrylate, and a silane, or with ethyl cellulose.

16. A developer composition in accordance with claim 11 wherein the pigment particles are comprised of carbon black.

17. A developer composition in accordance with claim 11 wherein the pigment particles are comprised of a material selected from cyan, magenta, scarlet, and yellow pigments, or mixtures thereof.

18. A developer composition in accordance with claim 11 wherein the cyan pigment is copper tetra-4(octadecylsulfonamido) phthalocyanine.

19. A developer composition in accordance with claim 11 wherein the magenta pigment is 2,9-dimethyl quinacridone.

20. A developer composition in accordance with claim 11 wherein the yellow pigment is 2,5-dimethoxy-4-sulfonoanilide phenylazo-4'-chloro-2,5-dimethoxyaceto-acetanilide.

21. A method for developing electrostatic latent images comprising forming a positive electrostatic latent image on an inorganic photoresponsive device, contacting the resulting image with a toner composition comprised of resin particles, pigment particles and a polyanhydride charge enhancing composition of the formula:

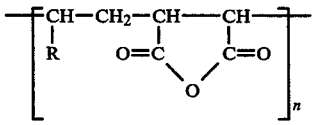

wherein R is an alkyl group containing from about 6 carbon atoms to about 22 carbon atoms, and n is a number ranging from about 5 to about 2,000, followed by transferring the image to a suitable substrate, and optionally permanently affixing the image thereto.

22. A method in accordance with claim 21 wherein the pigment particles are comprised of cyan, magenta, scarlet, and yellow pigments or mixtures thereof and there results color images.

23. A method of imaging in accordance with claim 21 wherein the polyanhydride composition is present in an amount of from about 0.1 weight percent to about 98 weight percent, and is a copolymer octadecene-1 and maleic anhydride, hexadecene-1 and maleic anhydride, tetradecene-1 and maleic anhydride, and dodecene-1 and maleic anhydride.

* * * * *